US006298677B1

(12) United States Patent
Bujak, Jr.

(10) Patent No.: US 6,298,677 B1
(45) Date of Patent: Oct. 9, 2001

(54) REVERSIBLE HEAT PUMP SYSTEM

(75) Inventor: Walter E. Bujak, Jr., Suffield, CT (US)

(73) Assignee: Carrier Corporation, Syracuse, NY (US)

( * ) Notice: Subject to any disclaimer, the term of this patent is extended or adjusted under 35 U.S.C. 154(b) by 0 days.

(21) Appl. No.: 09/472,620

(22) Filed: Dec. 27, 1999

(51) Int. Cl.[7] ..... G05D 23/32; F25D 17/02

(52) U.S. Cl. ..... 62/158; 62/201; 165/208; 165/218

(58) Field of Search ..... 62/160, 201, 158; 165/254, 208 F, 218 XF

(56) References Cited

U.S. PATENT DOCUMENTS 5,207,070 * 5/1993 Miyazaki ..... 165/208 X
5,245,835 * 9/1993 Cohen et al. ..... 165/208 X
5,303,767 * 4/1994 Riley ..... 165/208

* cited by examiner

*Primary Examiner*—William Wayner

(57) ABSTRACT

A control system for a reversible heat pump includes a system controller which polls the heating or cooling demands of zone controllers associated with a series of heat exchangers downstream of the heat pump. The system controller is operative to configure the heat pump in response to which of the demands is dominant. The system controller is also operative to change the configuration of the heat pump in response to a change in dominant demand. The implemented change in heat pump configuration is preferably premised on the temperature of water returned to the heat pump being within a predefined range of temperature. The return water temperature requirement may be overriden by the system controller if an acceptable period of time for allowing the returning water temperature to reach an acceptable temperature level has elapsed.

9 Claims, 5 Drawing Sheets

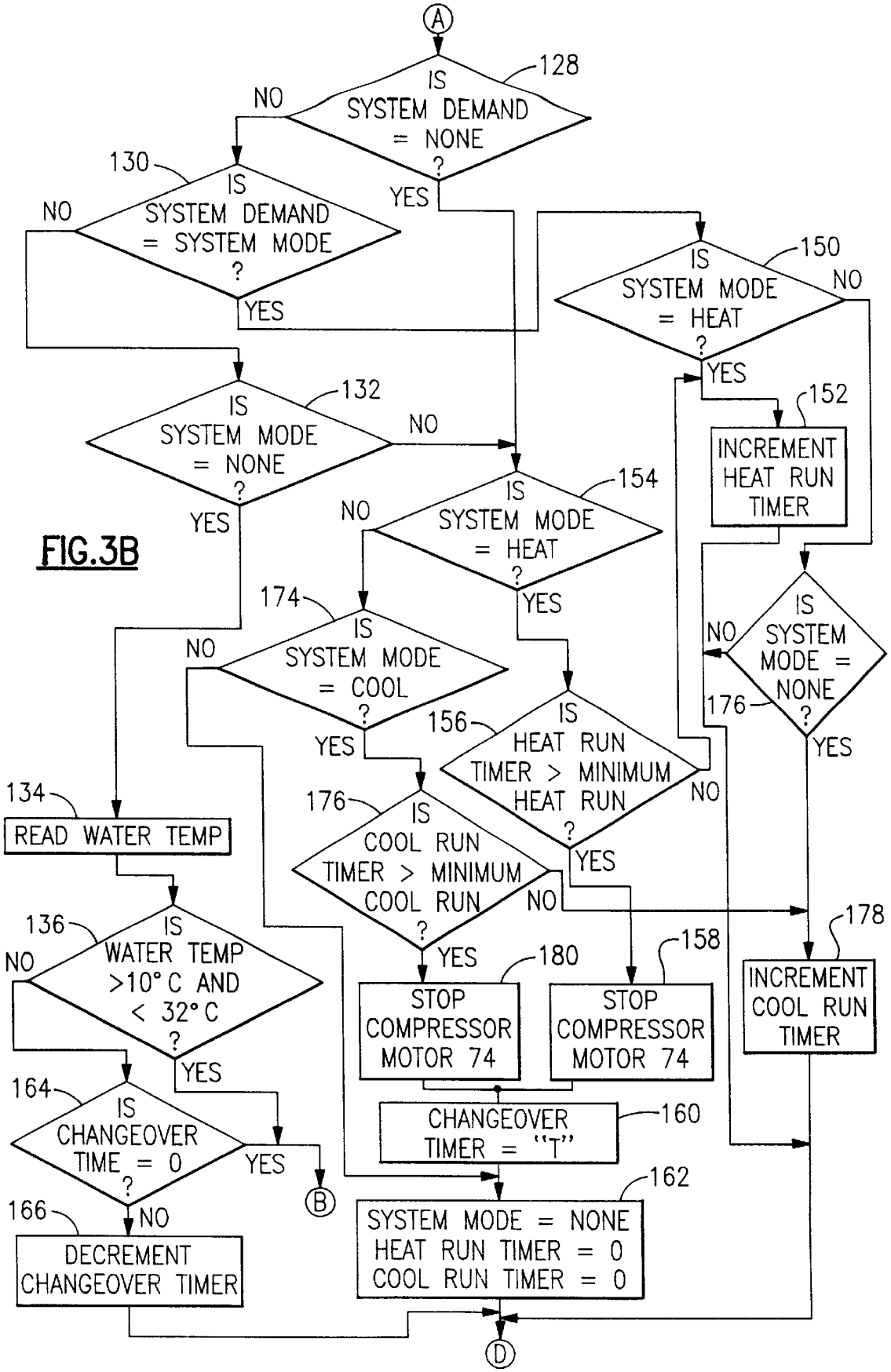
A
128
IS SYSTEM DEMAND = NONE ?
NO
YES
130
IS SYSTEM DEMAND = SYSTEM MODE ?
NO
YES
150
IS SYSTEM MODE = HEAT ?
NO
YES
132
IS SYSTEM MODE = NONE ?
NO
YES
152
INCREMENT HEAT RUN TIMER
154
IS SYSTEM MODE = HEAT ?
NO
YES
FIG.3B
174
IS SYSTEM MODE = COOL ?
NO
YES
IS SYSTEM MODE = NONE ?
NO
176
YES
156
IS HEAT RUN TIMER > MINIMUM HEAT RUN ?
NO
YES
134
READ WATER TEMP
176
IS COOL RUN TIMER > MINIMUM COOL RUN ?
NO
YES
178
INCREMENT COOL RUN TIMER
136
IS WATER TEMP >10° C AND < 32° C ?
NO
YES
180
STOP COMPRESSOR MOTOR 74
158
STOP COMPRESSOR MOTOR 74
164
IS CHANGEOVER TIME = 0 ?
YES
NO
B
CHANGEOVER TIMER = "T"
160
162
SYSTEM MODE = NONE
HEAT RUN TIMER = 0
COOL RUN TIMER = 0
166
DECREMENT CHANGEOVER TIMER
D

REVERSIBLE HEAT PUMP SYSTEM

BACKGROUND OF THE INVENTION

This invention relates to reversible heat pump systems which condition water that is to be circulated through one or more heat exchangers downstream of the heat pump system.

Heat pump systems which provide heated or cooled water to one or more heat exchangers are typically not required to switch from a heating mode to a cooling mode very often. This is in part due to the inherent inertia of a heat pump in trying to heat water that has been previously cooled. In this regard, the compressor within the heat pump must process a sufficient amount of refrigerant over time that can give up the necessary heat to the water that has been previously cooled. The compressor is presented with a similar heavy load situation when it is required to process a sufficient amount of refrigerant over time to absorb heat from previously heated water so as to produce cooled water. This inability to switch between heating and cooling or vice versa has previously led to switching the mode of operation of the heat pump system infrequently. For instance, changeovers would be implemented on particular calendar dates indicating normal change of seasonal weather conditions. On the other hand, a changeover might be implemented depending on a separately sensed outdoor air temperature indicating whether the heat pump system should be in either heating or cooling for the day. The above described changeover controls do not allow a heat pump system to respond to heating or cooling demands that may change throughout the day. The above described systems moreover do not respond to different demands for cooling or heating throughout a building on a given day.

OBJECTS OF THE INVENTION

It is an object of this invention to provide a heat pump system with the capability to automatically change from one operating mode to another operating mode at any time regardless of outdoor air temperature or calendar date.

It is another object of this invention to provide a heat pump system that will be responsive to different demands for cooling or heating throughout a building on a given day.

SUMMARY OF THE INVENTION

The above and other objects are achieved by providing a heat pump system controller with control logic, which continually polls the spaces or zones in which heating or cooling may be demanded so as to determine whether there is a predominance of either heating or cooling being demanded. The polling also checks to see whether a determined predominance of demand for either heating or cooling meets certain minimum demand requirements. In the event that minimum demand requirements are met, then a system demand is set reflecting the polling results. For instance, the system demand would be set for producing heated water if the predominance of polled spaces reflected that more spaces requested heating than requested cooling and that the number of spaces requesting heating exceeded some minimum number of spaces required to implement a changeover from cooling to heating. The system demand does not, however, allow for an immediate changeover to heating in the event that a changeover to heating is being requested by the polling results. In particular, the controller will first check to see whether the current mode of operation of the heat pump has been in effect for a minimum time period before stopping the then active compressor. The controller will preferably thereafter inquire as to whether a particular water temperature in the water return line to the heat pump is within a range of temperatures. This will allow the zone controllers associated with heat exchangers that are still demanding cooling to continue giving up heat to the circulating water so as to thereby increase the temperature of the returning water. During this time, the compressor will remain off so as to not be presented with an otherwise heavy load of trying to heat low temperature water. The controller may also override the requirement of raising the return water temperature to a desired temperature level in the event that a particular changeover period of time has elapsed since the compressor was turned off. It is only after the return water temperature is within range or the changeover time period has expired, if the latter is required, that the controller will proceed to actually authorize the changing of the valve position of a reversing valve within the heat pump system so as to configure the heat pump system to a heating mode of operation. The compressor will also be turned on at this point in time.

BRIEF DESCRIPTION OF THE DRAWINGS

For a fuller understanding of the present invention, reference should now be made to the following detailed description thereof taken in conjunction with the accompanying drawings wherein:

FIGS. 3A, 3B and 3C present a flow chart of the method used by the system controller within FIGS. 1 and 2 to control the configuration of the heat pump system of FIGS. 1 and 2.

DESCRIPTION OF THE PREFERRED EMBODIMENT

Figure 1:
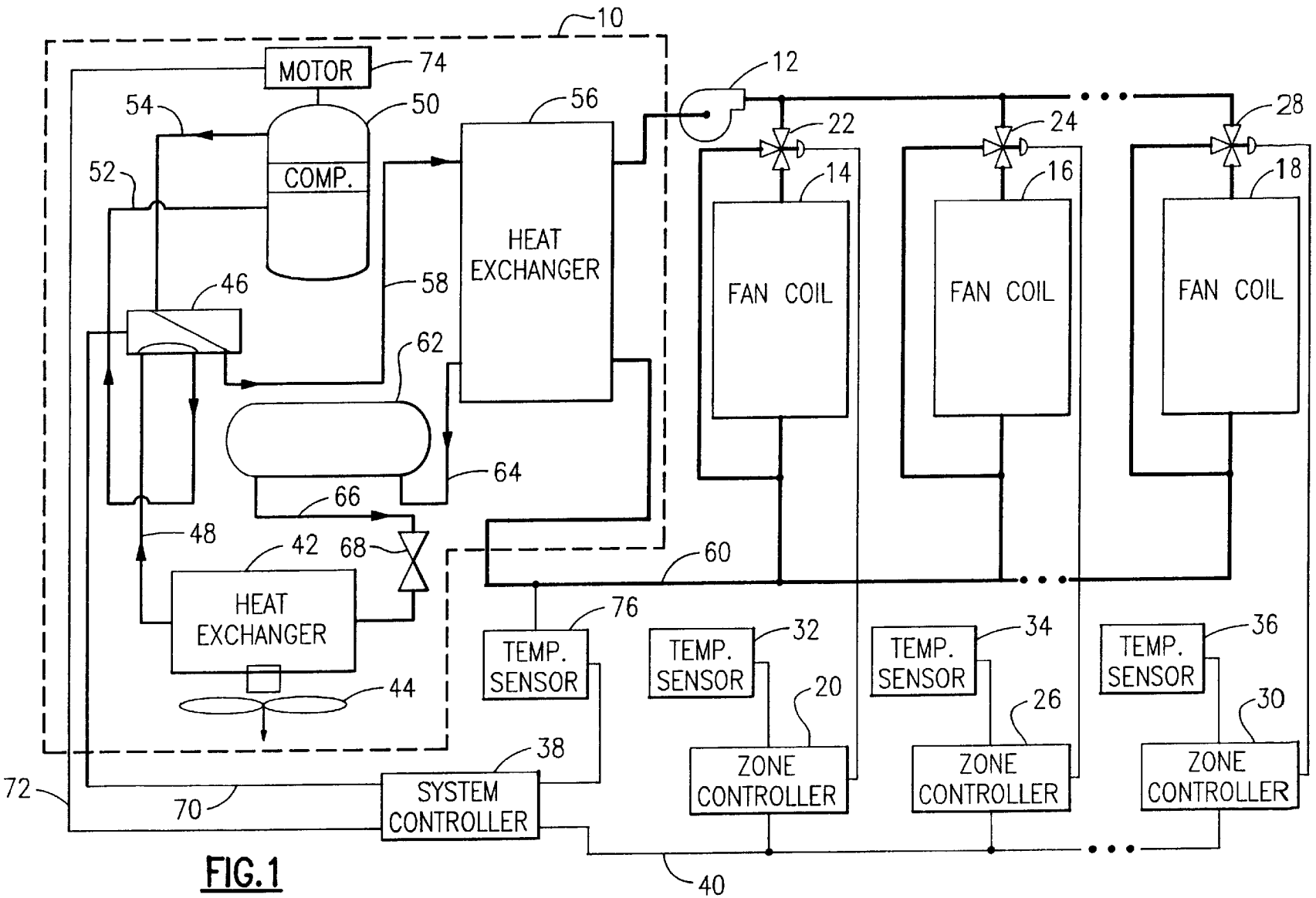
FIG. 1 is a schematic view of a heat pump system configured by a system controller to deliver heated water to heat exchangers associated therewith.

Referring to FIG. 1, a reversible heat pump system 10 delivers hot or cold water via a pump 12 to fan coil heat exchangers 14, 16 and 18. Each fan coil heat exchanger typically receives the heated or cooled water from the heat pump and conditions air flowing through the fan coil heat exchanger. The resultingly conditioned air is provided to a space that is to be heated or cooled. This space is often referred to as a "zone of heating or cooling". Water from the heat pump system 10 flows through the fan coil heat exchanger 14 in the event that a zone controller 20 authorizes such a flow by positioning of a control valve 22. The zone controller 20 may also divert any water flow around the fan coil heat exchanger 14 by a further positioning of the control valve 22. It is to be appreciated that the fan coil heat exchanger 16 operates in a similar fashion in response to the positioning of a control valve 24 under the control of a zone controller 26. It is furthermore to be appreciated that the last fan coil heat exchanger 18 will also be controlled by the positioning of a control valve 28 under the control of a zone controller 30. Water flow to each heat exchanger within each corresponding fan coil can either fully bypass the heat exchanger, fully flow through the heat exchanger, or partially flow through the heat exchanger and bypass. The control valve position is determined by the zone controller and is a function of the zone's heating or cooling requirement and the operating mode of the water loop. Each zone controller 20, 26 and 30 is also connected to a corresponding temperature sensor such as 32, 34 and 36, which senses the temperature in the respective zone serviced by the fan coil heat exchanger and provides such temperature information to the respective zone controller. Each zone controller will furthermore have a stored setpoint value for the particular zone. This may be a temperature that is arbitrarily defined by an individual either through a programmable thermostat or other device suitable for entering setpoint information. Each zone controller will either have a demand for heat or a demand for cooling or essentially a demand for neither heating or cooling depending on the sensed temperature in the zone versus the zone's stored setpoint. Each individual zone demand is provided to a system controller 38 via a bus 40. The system controller 38 is operative to analyze the collected zone demands so as to determine whether the heat pump system 10 should be in a heating or a cooling mode of operation.

The heat pump system 10 is shown operating in a heating mode in FIG. 1. In this mode, heat is extracted from air being drawn over a heat exchanger 42 by a fan 44. It is to be appreciated that the heat exchanger 42 could also remove heat from a medium other than air. For instance, heat could be extracted from a medium circulating through piping buried in the earth. In any event, refrigerant flowing through this heat exchanger absorbs a large quantity of heat from whatever the heat exchange medium is and stores it in vapor form for later release. The refrigerant in vapor form flows from heat exchanger 42 to a four way reversing valve 46 via a line 48. The four way reversing valve directs the refrigerant in vapor form to the suction inlet of a compressor 50 via a suction line 52. The compressor 50 discharges the refrigerant vapor at a high pressure to the reversing valve 46 via a line 54. The four way reversing valve directs the high pressure refrigerant vapor to heat exchanger 56 via a line 58. The heat exchanger 56 functions as a condenser in the heating mode. The heat of condensation of the condensing refrigerant circulating through the heat exchanger 56 is absorbed by water returning from the fan coil heat exchangers 14, 16, and 18 via a return line 60. The water exits the heat exchanger 56 as hot water being drawn by the pump 12. The refrigerant exits the heat exchanger 56 as a mixture of vapor and liquid refrigerant at high pressure and flows into a receiver 62 via a line 64. The pool of high pressure, hot refrigerant liquid in the receiver 60 is preferably subcooled before passing out of the receiver on a line 66 connected to a thermal expansion valve 68. The thermal expansion valve 68 allows the liquid refrigerant to expand to a lower pressure before entering the heat exchanger 42 wherein the liquid refrigerant evaporates absorbing heat from the air or other fluid medium as has been previously described.

Figure 2:
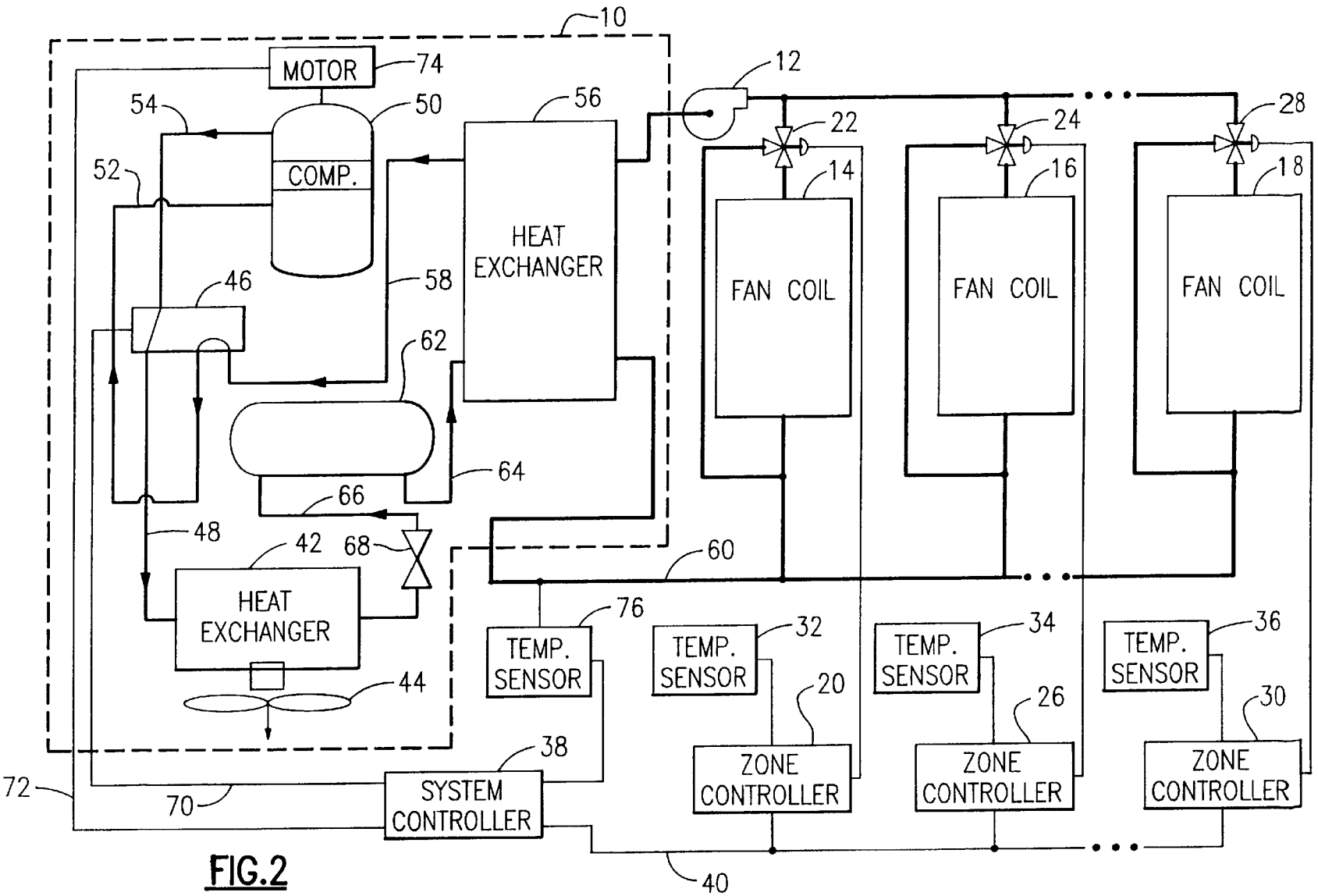
FIG. 2 is a schematic view of the heat pump system of FIG. 1 configured by the system controller to deliver cooled water to heat exchangers associated therewith.

Referring now to FIG. 2, the heat pump system 10 is illustrated in a cooling mode of operation. In the cooling mode, the four way reversing valve 46 directs hot refrigerant vapor discharged by the compressor 50 via line 54 to heat exchanger 42 via line 48. The heat of condensation is preferably removed from the hot refrigerant vapor by air flowing over the heat exchanger 42 . This produces high pressure subcooled liquid refrigerant at the outlet end of the heat exchanger 42. This high pressure subcooled liquid refrigerant flows into the thermal expansion valve 68 and is discharged at a lower pressure. The refrigerant passes through the receiver 60 and enters the heat exchanger 56 operating as an evaporator in this instance. Heat will be extracted from the water circulating through the heat exchanger 56. The circulating water is the water returning from the fan coil heat exchangers 14, 16, and 18 via return line 60. The resulting chilled or cooled water is drawn out of the heat exchanger 56 by pump 12. The low pressure refrigerant vapor is discharged from the heat exchanger 56 via line 58 and is directed by the four way reversing valve 12 to the suction inlet of the compressor 50 via line 52.

Referring again to the system controller 38, the system controller sends a heating or cooling signal to the four way reversing valve 46 via a line 70. The four way reversing valve responds to a heating signal by switching to the valve positions shown in FIG. 1 thereby configuring the heat pump system into a heating mode. The four way reversing valve responds to a cooling signal by switching to the valve positions shown in FIG. 2 thereby configuring the heat pump system into a cooling mode. The system controller also sends a signal via a line 72 to a motor 74 for the compressor 50 so as to deactivate the motor 74 when the heat pump system is transitioning from heating to cooling or vice versa. The system controller preferably uses the same line 72 to activate the motor 74 when the transition from one mode to another has been completed. The system controller receives a temperature of the water returning to the heat pump system from a temperature sensor 76 located in the return line 60

Figure 3A:
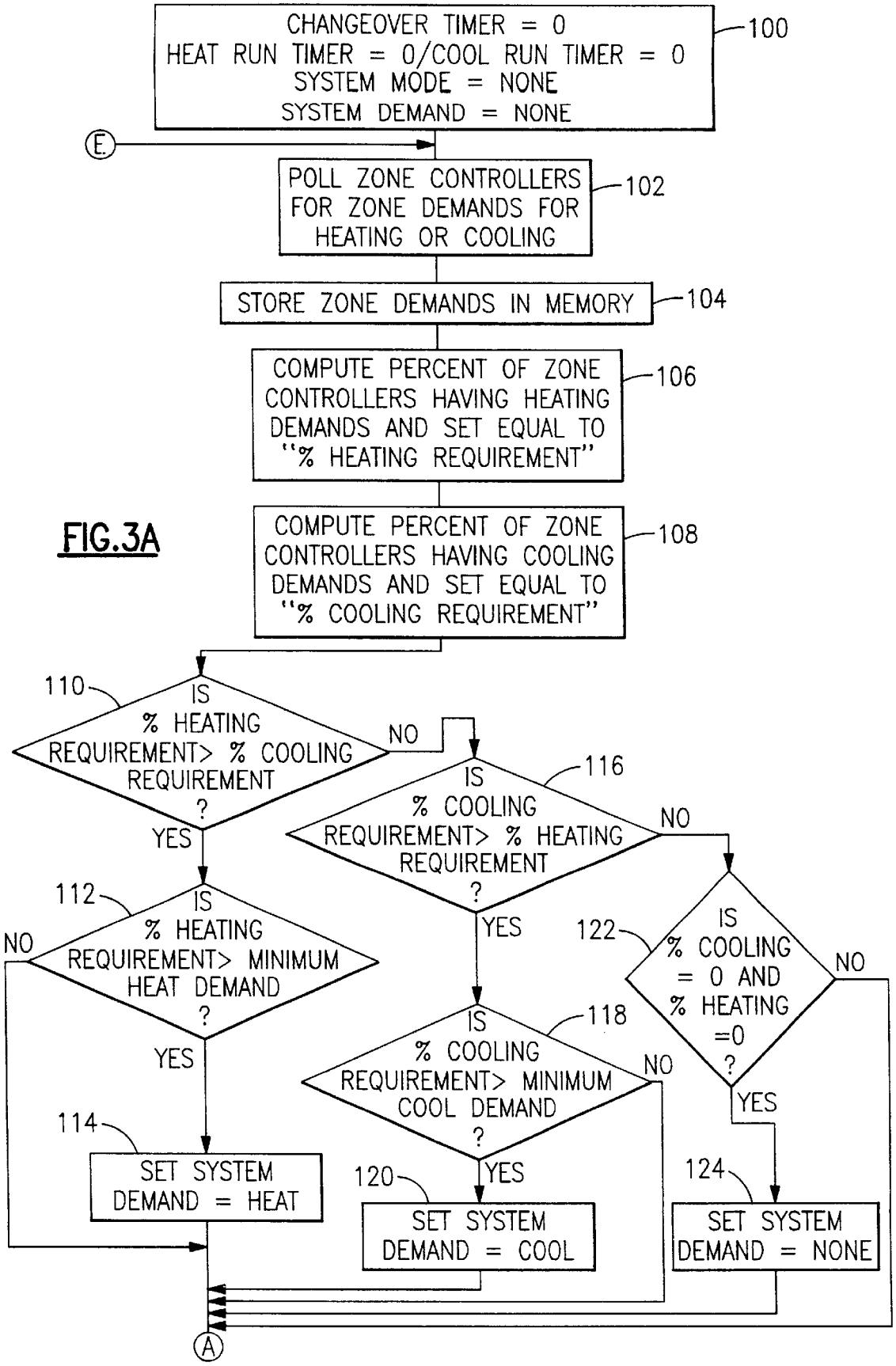
Figure 3C:
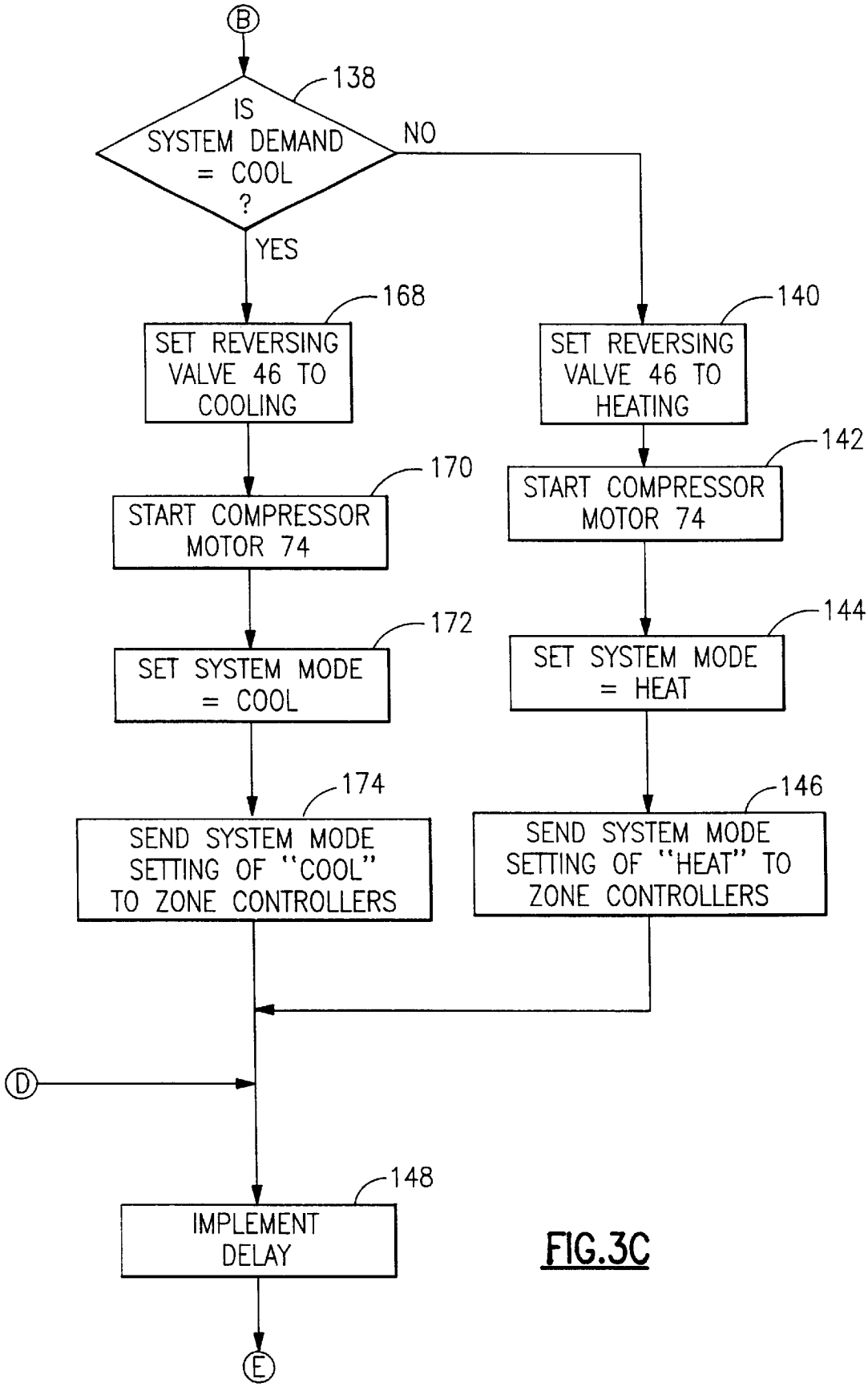

Referring now to FIGS. 3A, 3B and 3C, a process utilized by a programmable microprocessor within the system controller 38 is illustrated. The process begins with an initialization step 100, which sets the initial values of the following variables: "changeover timer", "heat run timer", "cool run timer", and "system demand" and"system mode. The microprocessor within the system controller 38 will proceed to a step 102 and poll each of the zone controllers for their respective zone demands for heating or cooling. It is to be appreciated that this is preferably done by addressing each zone controller 20, 26 and 30 via the bus 40 and requesting the specific zone demand of the zone controller. The zone demand will of course be a function of the difference between setpoint and sensed temperature in the respective zone. The zone demands are stored in a memory associated with the microprocessor within the system controller 38 in a step 104. The microprocessor proceeds to a step 106 and computes the percentage of the polled zone controllers that have heating demands. This is preferably done by first adding up the number of zone controllers having a heating demand and dividing this number by the total number of zone controllers associated with the heat pump system. The results are stored as "percent heating requirement". The microprocessor within the system controller proceeds to a step 108 and computes the percentage of zone controllers having cooling demands in a similar fashion. In other words, the microprocessor first adds up the number of zone controllers having cooling demands and divides this number by the total number of zone controllers associated with the heat pump system and stores the result as "percent cooling requirement".

The microprocessor proceeds to a step 110 and inquires whether the percent heating requirement computed in step 106 is greater than the percent cooling requirement computed in step 108 . The microprocessor within the system controller 38 will proceed to step 112 in the event that the percent heating requirement exceeds the percent cooling requirement. Referring to step 112, the processor will inquire as to whether the percent heating requirement computed in step 106 is greater than a "minimum heat demand". The minimum heat demand is preferably a stored percentage value in the memory associated with the microprocessor. This percentage value should be slightly less than the percentage of zone controllers that must be demanding heat in the system of FIG. 1 in order for the system to change over to providing heated water. When this percentage is exceeded, the microprocessor within the system controller will proceed in a step 114 to set "system demand" equal to heat.

Referring again to step 110, in the event that the percent heating requirement does not exceed the percent cooling requirement, the processor proceeds to a step 116 and inquires as to whether percent cooling requirement is greater than percent heating requirement. In the event that the answer is yes, the processor will proceed to a step 118 and inquire as to whether the percent cooling requirement is greater than a minimum cooling demand for the heat pump system of FIG. 1. This minimum cooling demand will be slightly less than the percentage of zone controllers that must be demanding cooling in order to have the processor proceed in a step 120 to set system demand equal to cool.

Referring again to step 116, in the event that the percent cooling requirement is not greater than the percent heating requirement, then the processor will proceed to a step 122 and determine if both the percent cooling and the percent heating equal zero. If both are equal and zero, the processor will proceed to set the "system demand" equal to none in a step 124. In the event that both demands are not equal to zero in step 122, then the processor will proceed directly to a step 128.

Referring to step 128, it is to be appreciated that the processor will have proceeded from either step 114, step 120 or step 124 to this step with a particular setting of system demand. The processor will also have proceeded to this step from step 122 without changing the present system demand established previously. For instance, if the "system demand" is "none" as a result of its initial setting in step 100, then it will continue to be so after exiting step 122 along the "no" path. If on the other hand, the "system demand" were previously set in a prior execution of the logic, then that would be the system demand setting after exiting step 122 along the "no path".

It is noted that the processor inquires as to whether the system demand equals none in step 128. Assuming the system demand is heat as a result of step 114, the processor will proceed along the no path out of step 128 to a step 130 and inquire as to whether the value of system demand equals the value of "system mode". Since the processor will be operating immediately after initialization, the system mode value will be none prompting the processor to proceed along the no path to a step 132.

Referring to step 132, the processor will inquire whether the value of system mode is equal to none. Since system mode will be equal to none initially, the processor will proceed along the yes path to a step 134 and read the water temperature from sensor 52 in the return line 60. The processor proceeds in a step 136 to inquire as to whether the water temperature read in step 134 is greater than ten degrees Centigrade and less than thirty-two degrees Centigrade. Since the heat pump system is not recovering from any previous heating or cooling mode of operation, the water temperature in the return line should be within this range of temperatures. This will prompt the processor to proceed along the yes path to a step 138 wherein inquiry is made as to whether system demand is equal to cool. Since the system demand was set equal to heat in step 114 , the processor will proceed out of step 138 along the no path to a step 140 and set the four way reversing valve 46 to heating. The processor will start the compressor motor 74 in a step 142.

The processor proceeds to set "system mode" equal to heat in a step 144. The processor will proceed from step 144 to a step 146 and send the system mode setting of "heat" to the zone controllers 20, 26, and 30. Each zone controller will use the communicated setting to determine how to position its control valve. In this regard, if the local demand is for heating, then the control valve will be positioned by the zone controller so as to deliver hot water from the boiler to the fan coil heat exchanger. If the local demand is however for cooling, then the hot water from the boiler will bypass the fan coil heat exchanger. It is to be appreciated that the above assumes that the local zone controller is not able to independently determine whether the water being delivered is hot or cold. In the event that the zone controllers possess the capability of independently determining the temperature of the water being delivered, then they will implement the positioning of their respective control valves without the need to receive the system mode setting from the system controller 38. The processor will proceed from step 146 to a step 148 wherein a predefined time delay will be implemented before returning to step 102. It is to be appreciated that the amount of time delay will be an arbitrarily defined amount of time so as to delay the system controller before it again polls the zone controllers in step 102.

Referring again to steps 102–124, the processor within the system controller will poll the zone controllers and thereafter compute the percentages of zone controllers having heat demands and the percentage of zone controllers having cooling demands before again determining whether or not the percentage heating requirement is greater than the percentage cooling requirement in a step 110. Assuming that the zone controllers continue to have essentially the same demands, then the percent heating requirement will continue to exceed the percent cooling requirement so as to thereby prompt the processor to proceed from step 110 to step 112 and again inquire as to whether the minimum heat demand has been exceeded before again setting the system demand equal to heat in step 114. The processor will proceed to step 128 and again inquire as to whether the system demand is equal to none. Since the system demand will be equal to heat, the processor will proceed to step 130 and inquire as to whether system demand equals system mode. Since system mode will now be equal to heat, the processor will proceed along the yes path to a step 150 and inquire as to whether system mode equals heat. Since system mode will be equal to heat, the processor will proceed to a step 152 and increment a "heat run timer". The heat run timer will be incremented for the first time since the heat run timer was initially set equal to zero. It is to be appreciated that the amount by which the heat timer will be incremented will preferably be the same as the amount of delay set forth in step 146 between successive executions of the control logic. The processor will proceed from step 152 to step 148 wherein the delay will be again implemented before returning to step 102.

It is to be appreciated that the processor within the system controller will continue to execute the control logic in the manner that has been previously discussed until there has been a change in the demands of the zone controllers so as to cause a change in the percentage heating requirement and percentage cooling requirements as computed in steps 106 and 108. Assuming that the results produce a higher cooling requirement than heating requirement, then the processor will proceed out of step 110 to step 116 and hence to step 118 since the percentage cooling requirement will now exceed the percentage heating requirement. This will prompt the processor to inquire as to whether the percentage cooling requirement is greater than the minimum cooling demand required in step 118. Assuming that the minimum cooling demand percentage has been met, the processor will proceed to set system demand equal to cool in step 120. It is hence to be appreciated that the polling logic of steps 102 through 124 will have recognized a change in the zone controller demands sufficient to prompt the change of system demand from heat to cool.

The processor proceeds from step 120 to a step 128 and inquires as to whether system demand equals none. Since system demand will now be equal to cool, the processor will proceed along the no path to step 130 and inquire as to whether system demand still equals the value of system mode. Since system demand will have changed from heat to cool, the processor will proceed along the no path to step 132 and inquire as to whether system mode equals none. Since system mode will still be equal to heat, the processor will proceed along the no path to a step 154 and inquire as to whether system mode equals heat. Since system mode will still be equal to heat, the processor will proceed to a step 156 and inquire as to whether heat run timer is greater than minimum heat run. It will be remembered that the heat run timer will have been successively incremented in step 152 each time the processor within the system controller executes the control logic of FIG. 2. Assuming that the heat pump system has been in a heating mode of operation for a considerable period of time, the heat run timer will normally exceed any minimum amount of time established for a heat run of the heat pump system of FIG. 1. It is to be appreciated that this particular time value for minimum heat run will be stored in memory for use by the processor within the system controller. Assuming that the heat run timer has exceeded this minimum heat run value, the processor will proceed to a step 158 and issue a stop signal on the line 72 to deactivate the compressor motor 74.

The processor will proceed from step 158 to a step 160 and set the changeover timer. The change over timer will be set equal to a predetermined changeover time period, "T" that the heat pump system of FIG. 1 must experience before it can be switched from heating to cooling. This changeover time period will have been stored in memory associated with the processor. The processor will proceed in a step 162 to set system mode equal to none and both heat run timer and cool run timer equal to zero. The processor will then proceed to step 148 and again implement the prescribed amount of delay before the next execution of the control logic.

At such time as the next execution occurs, the processor will again poll the zone controllers in a step 102 and compute the percentage heat requirement and cooling requirement in steps 106 and 108. Assuming that the percentage cooling requirement continues to now exceed percentage heating requirement, the processor will again execute steps 110, and 116 through 120 and again set the system demand equal to cool. This will prompt the processor to proceed through step 128 to step 130 since system demand will be equal to cool. Since system demand will not equal system mode at this time, the processor will proceed along the no path to step 132 to inquire whether system mode equals none. Since system mode will have been previously set equal to none in step 162, during the previous execution of the control logic, the processor will proceed along the yes path to step 134 and read the water temperature from the water temperature sensor 76 in the return line from the fan coil heat exchangers. The processor will proceed to inquire as to whether the water temperature read from sensor 76 is between the range of temperatures set forth in step 136. Since the compressor motor 74 will have just recently been turned off, the water temperature in the return line should be above thirty two degrees Centigrade so as to prompt the processor to proceed along the no path out of step 136 to a step 164 and inquire as to whether the changeover timer set in step 160 is equal to zero. The changeover timer will have just been set equal to a predetermined changeover time in the previous execution of the control logic. This will prompt the processor to proceed along the no path to a step 166 and decrement the changeover time previously loaded into the change over timer. It is to be appreciated that the amount of time thereby decremented will be essentially the delay time defined by step 148 between successive executions of the control logic. The processor proceeds from step 166 to step 148 wherein the delay is again implemented before the next successive execution of the control logic.

It is to be appreciated that successive executions of the control logic will occur as long as the zone controllers continue to indicate a higher percentage cooling requirement than heating requirement and that this higher percentage cooling requirement remains greater than the minimum cooling demand. At some point during the successive executions of the control logic, the processor may note in step 136 that the water temperature in the return line is within the range of the temperatures set forth in step 136. On the other hand, the processor may note that the changeover timer has been decremented to zero in step 164 before the water temperature in the return line is within range. In either case, the processor will proceed from step 136 or step 164 to step 138 and inquire as to whether the system demand equals cool. Since the system demand will have been continually set equal to cool each time step 120 is encountered, the processor will proceed to step 168 and set the four way reversing valve 46 to a cooling position. This will prompt the heat pump system 10 to assume the configuration of FIG. 2. The processor will thereafter proceed to step 170 and activate the compressor motor 74. The processor will then proceed to a step 172 and set the system mode equal to cool. The processor will proceed to step 174 and send the system mode setting of "cooling" to the zone controllers 20, 26, and 30. Each zone controller will use the communicated setting to determine how to position its control valve. In this regard, if the local demand is for cooling, then the control valve will be positioned by the zone controller so as to deliver cooled water from the chiller to the fan coil heat exchanger. If the local demand is however for heating, then the cooled water from the chiller will bypass the fan coil heat exchanger. It is to be appreciated that the above assumes that the local zone controller is not able to independently determine whether the water being delivered is hot or cold. In the event that the zone controllers possess the capability of independently determining the temperature of the water being delivered, then they will implement the positioning of their respective control valves without the need to receive the system mode setting from the system controller 38.

It is hence to be appreciated that the control logic will have implemented a changeover from heating to cooling in the event that the changeover time as defined by the changeover timer elapses or in the event that the water temperature sensor is within the predefined range of water temperatures in step 136. It is furthermore to be appreciated that the control logic can possibly implement a changeover from cooling back to heating when the percentage heating requirement exceeds the percentage cooling requirement at some point during the successive executions of control logic. At such time, the system demand will be set equal to heat in step 114 prompting the processor to proceed through steps 128, 130, 132 to step 154 to inquire whether the system mode is equal to heat. Since the system mode will still be equal to cool, the processor will proceed from step 154 along the no path to step 174 to inquire whether the system mode is equal to cool. Since system mode will still be equal to cool, the processor will proceed to a step 176 to inquire whether the cool run timer is greater than the minimum cool run time. If the cool run timer has not been sufficiently incremented so as to exceed the minimum cool run time, the processor will proceed to step 178 and increment the cool run timer before returning to step 148. The processor will again execute the aforementioned logic steps of 114, 128, 130, 132, 154, 174 and 176 until the cool run timer exceeds the minimum cool run time. At this point, the processor will proceed to stop the compressor motor 74 before setting the changeover timer equal to "T" in step 160. The processor will proceed to step 162 and set system mode equal to none and heat run timer and cool run timer equal to zero. The processor will proceed to step 148 and implement the delay before again polling the zone controllers in step 102. Assuming that the polling continues to indicate that heating requirements exceed cooling requirements, the processor will proceed though steps 110–114, 128 to step 132. Since the system mode is now equal to none, the processor will proceed to implement steps 134, 136, and steps 164–166 and then 148 until such time as the water temperature read in step 134 is within range or the changeover timer has been decremented to zero. At such time, the processor will proceed to step 138 and hence to steps 140–146 so as to change the heat pump system to a heating mode of operation.

Referring again to step 116, it is to be noted that there may a situation wherein the particular polling by the processor will indicate that there is neither a predominance of heating or cooling being required by the zone controllers. In this case, the processor will proceed to step 122 and inquire as to whether the percent cooling requirement and the percent heating requirement are both equal to zero. If this is the case, the processor proceeds to set the system demand equal to none in a step 124 prompting the processor to proceed to step 128. Depending upon the previous system mode setting, the processor will proceed through either step 154 or step 174 in order to stop the compressor motor 74 and set the system mode equal to none. The processor will proceed through step 148 before again implementing the aforementioned logic as long as the polling requirements remain unchanged.

Referring again to step 122, in the event that the percent cooling requirement and percent heating requirement do not equal zero, the processor will proceed to step 128. Since the system requirements and system mode will be whatever was previously determined, the processor will proceed to step 130 where it will then proceed along the yes path and increment the appropriate run timer for whatever mode it is currently in.

It is to be appreciated that the control logic of FIGS. 3A, 3B and 3C allow the system controller 38 to potentially initiate a changeover from either heating to cooling or vice versa in response to the polling of the zone controllers 20, 26, and 30. This changeover will actually occur only when certain requirements are met. Specifically, the heat pump system must have been running in what ever mode it is presently in for a minimum time. Secondly, the water temperature must be within the predefined temperature range or the changeover timer must have expired indicating that the change over time has been exceeded. It is only after such events have occurred that the system controller will authorize the repositioning of the four-way reversing valve 46 and activate the compressor motor 74.

It is to be appreciated that preferred embodiments of the invention have been disclosed. Alterations or modifications may occur to one of ordinary skill in the art. For instance, the control logic may be altered so as to not require a sensing of water temperature in the return line. In this case, the changeover time would be the governing factor as to whether a changeover would be allowed to occur. It will be appreciated by those skilled in the art that further changes could be made to the above-described without departing from the scope of the invention. Accordingly, the foregoing description is by way of example only and the invention is to be limited only by the following claims and equivalents thereto.

What is claimed is:

1. A control system for controlling a reversible heat pump system capable of either heating water or cooling water to be delivered to a plurality of heat exchangers, said control system comprising:

a plurality of zone controllers, each zone controller connected to a respective heat exchanger so as to control the delivery of water to the respective heat exchanger, each zone controller being operative to generate a demand for either heated water, cooled water or no water;

a heat pump system controller in communication with each of said zone controllers, said heat pump system controller being operative to periodically receive each zone controller's demand for either heated water, cooled water or no water, said heat pump system controller being furthermore operative to periodically determine whether there is a predominance of heating or cooling demands being received from said zone controllers, said heat pump system controller being still furthermore operative to normally set a reversing valve within the heat pump system so as to configure the heat pump system to heating when there is a predominance of heating demands received from said zone controllers or set the reversing valve within the heat pump system so as to configure the heat pump system to cooling when there is a predominance of cooling demands received from said zone controllers; and a temperature sensor for sensing the temperature of the water returning to the heat pump system wherein said heat pump system controller is operative to set the reversing valve so as to configure the heat pump to either heating or cooling only if the sensed temperature of the returning water is within a predefined temperature range.

2. The control system of claim 1 wherein said heat pump system controller is operative to send a message to each of the zone controllers indicating whether heated water or cooled water is to be provided to the heat exchangers and wherein each of said zone controllers is operative to control the delivery of water to the respective heat exchanger controlled by said zone controller depending on whether the zone controller's demand is for heated water, cooled water or no water.

3. The control system of claim 1 wherein said heat pump system controller is furthermore operative to stop a compressor within the heat pump system in response to having determined a predominance of demands from the zone controllers which differs from the preceding predominance of demands from the zone controllers, said heat pump system control being furthermore operative to switch the reversing valve so as to configure the heat pump system to a different mode of operation in the event that a predetermined period of time has elapsed.

4. The control system of claim 3 further comprising:

a temperature sensor for sensing the temperature of the water returning to the heat pump system wherein said heat pump system controller is operative to switch the reversing valve so as to configure the heat pump system to a different mode of operation in the event that the sensed temperature of the returning water is within a predefined temperature range before the predetermined period of time has elapsed.

5. The control system of claim 3 wherein said heat pump system controller is furthermore operative to only stop the compressor within the heat pump system in the event that a predetermined run time of the compressor has elapsed for the current mode of operation of the heat pump system.

6. A process for controlling the provision of conditioned water by a reversible heat pump system to a plurality of heat exchangers, under the control of zone controllers, said process comprising the steps of:

periodically polling the plurality of zone controllers for the heat exchangers to obtain the demands for heated water, cooled water or no conditioned water from the zone controllers;

configuring the heat pump system so as to provide heated water to the heat exchangers in response to the polling results indicating a predominance of demands for heated water and configuring the heat pump system to provide cooled water to the heat exchangers in response to the polling results indicating a predominance of demands for cooled water; and switching a reversing valve within the heat pump system so as to configure the heat pump system from providing heated water to providing cooled water to the heat exchangers in response to the polling results continually indicating a predominance of demands for cooled water over a predetermined period of time and switching the reversing valve within the heat pump system so as to configure the heat pump system from providing cooled water to providing heated water to the heat exchangers in response to the polling results continually indicating a predominance of demands for heated water over the predetermined period of time.

7. The process of claim 6 further comprising:

switching the reversing valve so that the heat pump system will be configured to providing cooled water before the predetermined period of time has elapsed in the event that the water returning to the heat pump system from the heat exchangers is within a predefined range of temperatures; and switching the reversing valve so that the heat pump system will be configured to providing heated water before the predetermined period of time has elapsed in the event that the water returning to the heat pump system from the heat exchangers is within a predefined range of temperatures.

8. The process of claim 6 further comprising the steps of:

initiating a tracking of the predetermined period of time that must elapse before the switching to either providing cooled water or the switching to providing heated water; and delaying said step of initiating the tracking of the predetermined period of time that must elapse before the switching in the event that a second predetermined period of time has not elapsed since the current provision of heated or cooled water to the heat exchangers was initiated.

9. The process of claim 6 wherein said step of configuring the heat pump system so as to provide heated water comprises activating a compressor within the heat pump system upon switching the reversing valve so as to produce high pressure refrigerant to be condensed in a heat exchanger within the heat pump system which gives up heat to the returning water circulating through the heat exchanger within the heat pump system and wherein said step of configuring the heat pump system so as to provide cooled water comprises activating a compressor within the heat pump system upon switching the reversing valve so as to produce liquid refrigerant to be evaporated in the heat exchanger within the heat pump system so as to absorb heat from the returning water circulating through the heat exchanger within the heat pump system.

* * * * *